US005592716A

United States Patent [19]

Morén et al.

[11] Patent Number: 5,592,716

[45] Date of Patent: Jan. 14, 1997

[54] DEVICE FOR A VACUUM CLEANER AND A METHOD FOR COOLING A MOTOR

[75] Inventors: Lars G. Morén, Huddinge; Christer C. I. Wiss, Lidingö; Magnus C. W. Lindmark, Stockholm, all of Sweden

[73] Assignee: Aktiebolaget Electrolux, Stockholm, Sweden

[21] Appl. No.: 327,916

[22] Filed: Oct. 24, 1994

[30] Foreign Application Priority Data

Nov. 2, 1993 [SE] Sweden ..... 9303598
Nov. 2, 1993 [SE] Sweden ..... 9303599

[51] Int. Cl.[6] ..... A47L 9/28

[52] U.S. Cl. ..... 15/412; 15/413

[58] Field of Search ..... 15/413, 339, 412

[56] References Cited

U.S. PATENT DOCUMENTS

| | | | |
|---|---|---|---|
| 2,064,344 | 12/1936 | Good | 15/413 X |
| 2,073,489 | 3/1937 | Leathers | 15/413 X |
| 2,244,165 | 6/1941 | Mac Farland et al. | 15/413 X |
| 2,309,583 | 1/1943 | Frantz | 15/413 X |
| 2,823,411 | 2/1958 | Kirby | 15/413 X |
| 3,383,765 | 5/1968 | Meltzer | 15/413 X |
| 4,088,424 | 5/1978 | Hyatt et al. | 15/413 X |
| 4,969,797 | 11/1990 | Takara et al. | 417/423.13 X |

FOREIGN PATENT DOCUMENTS 3710622 12/1990 Germany .

OTHER PUBLICATIONS

English abstract of German Patent No. 3710622.

Marked–up Figure 1 of German Patent No. 3710622.

*Primary Examiner*—Chris K. Moore
*Attorney, Agent, or Firm*—Pearne, Gordon, McCoy & Granger

[57] ABSTRACT

A vacuum cleaner having a suction nozzle and a dust bag (12) which is connected to the nozzle, for instance, by a tube connection, and a turbo-fan unit (27) driven by an electric motor and placed after the dust bag seen in the flow direction. The impeller (29) of the turbo-fan unit is driven at a speed above 50,000 rpm. A primary air stream created by the turbo-fan unit (27) leaves the unit via an outlet (30) to atmosphere. The vacuum cleaner also creates a secondary air stream which at least partially cools the electric motor (32) and which flows into the electric motor via one or several cooling air inlets (44) which are separated from the primary air stream. The secondary air stream can be created by a cooling fan which is separate or integral with the impeller, by a venturi-type nozzle, or by suction created by the impeller. The primary air stream flows in one direction through a channel surrounding a motor shell and the secondary air stream flows in a second, opposite direction through the motor shell and is thereafter redirected and mixed with the primary air stream.

15 Claims, 7 Drawing Sheets

DEVICE FOR A VACUUM CLEANER AND A METHOD FOR COOLING A MOTOR

BACKGROUND OF THE INVENTION

This invention relates to a device for a vacuum cleaner having a suction nozzle and a dust bag, wherein the dust bag is connected to the suction nozzle, for instance, by means of a tube connection, and a turbo-fan unit is driven by an electric motor and placed after the dust bag, as seen in the direction of air flow. The impeller of the fan is driven at a speed above 50,000 rpm, and the primary air flow created by the unit leaves the unit via an outlet to atmosphere.

Vacuum cleaners of the above-mentioned type are described in WO 94/15518 and 94/15519, respectively, and mainly have the advantage that, because of the small dimensions of the vacuum source, they can be manufactured as small, hand-held appliances which are easy to handle and store while having suction power on the same level as previously known traditional vacuum cleaners, i.e., such having a power demand of between 500 and 1500 W.

In order to cool the electric motor in conventional vacuum cleaners the air flow, which is created by the fan and which is used for sucking up particles through the nozzle, is used. When the particles have been separated from the air in the dust bag and the air has passed through the fan, the air passes outside and through the electric motor before it exits the vacuum cleaner to atmosphere. This method of cooling the electric motor cannot be used in vacuum cleaners with small, high speed motors since the air which reaches the motor, despite the separation of the particles, is still dirty or contaminated, and can cause damage to the motor. It is a further risk in small, high speed motors that larger particles or details might follow the air flow into the motor if, for any reason, the dust bag would break, and that these particles would damage the motor due to the small dimensions of the motor and the narrow air passages provided therein.

Therefore, there exists a need in the art for a method of cooling small, high speed motors used in vacuum cleaners, and for a vacuum cleaner having a small, high speed motor which is cooled by an air stream independent of the primary dirt-laden air stream.

SUMMARY OF THE INVENTION

The present invention provides a method for cooling a small, high speed vacuum cleaner motor and a vacuum cleaner having a small, high speed motor which is cooled by an air stream independent of a primary dirt-laden air stream.

In accordance with the present invention, a vacuum cleaner includes a turbo-fan unit, including an impeller driven by an electric motor which is located after a dust bag, as seen in a direction of air flow. The impeller is driven at a speed in excess of 50,000 rpm by the electric motor and produces a primary stream of air which flows around the motor and cools the motor.

In further accordance with the present invention, means are provided for creating a secondary stream of air within the vacuum cleaner for cooling the motor. The secondary air stream is directed through the motor in a direction opposite to that of the primary air stream and, after flowing through the motor, is re-directed and mixed with the primary air stream.

As noted previously, since high speed motors, because of their small dimensions and, hence, concentrated heat emission, are sensitive to disturbances in cooling air flow, there is a risk that the motor will be quickly damaged if the cooling air flow should be blocked because the nozzle or air passages to the motor are clogged by dust or larger particles. According to several embodiments of the present invention, a sufficient cooling of the vacuum cleaner motor is achieved even if the air flow through the dust bag should be disturbed or blocked.

BRIEF DESCRIPTION OF THE DRAWINGS

For a more complete understanding of the present invention and for further advantages thereof, reference is now made to the following detailed description taken in conjunction with the accompanying drawings in which.

DETAILED DESCRIPTION OF THE PREFERRED EMBODIMENTS

Figure 1:
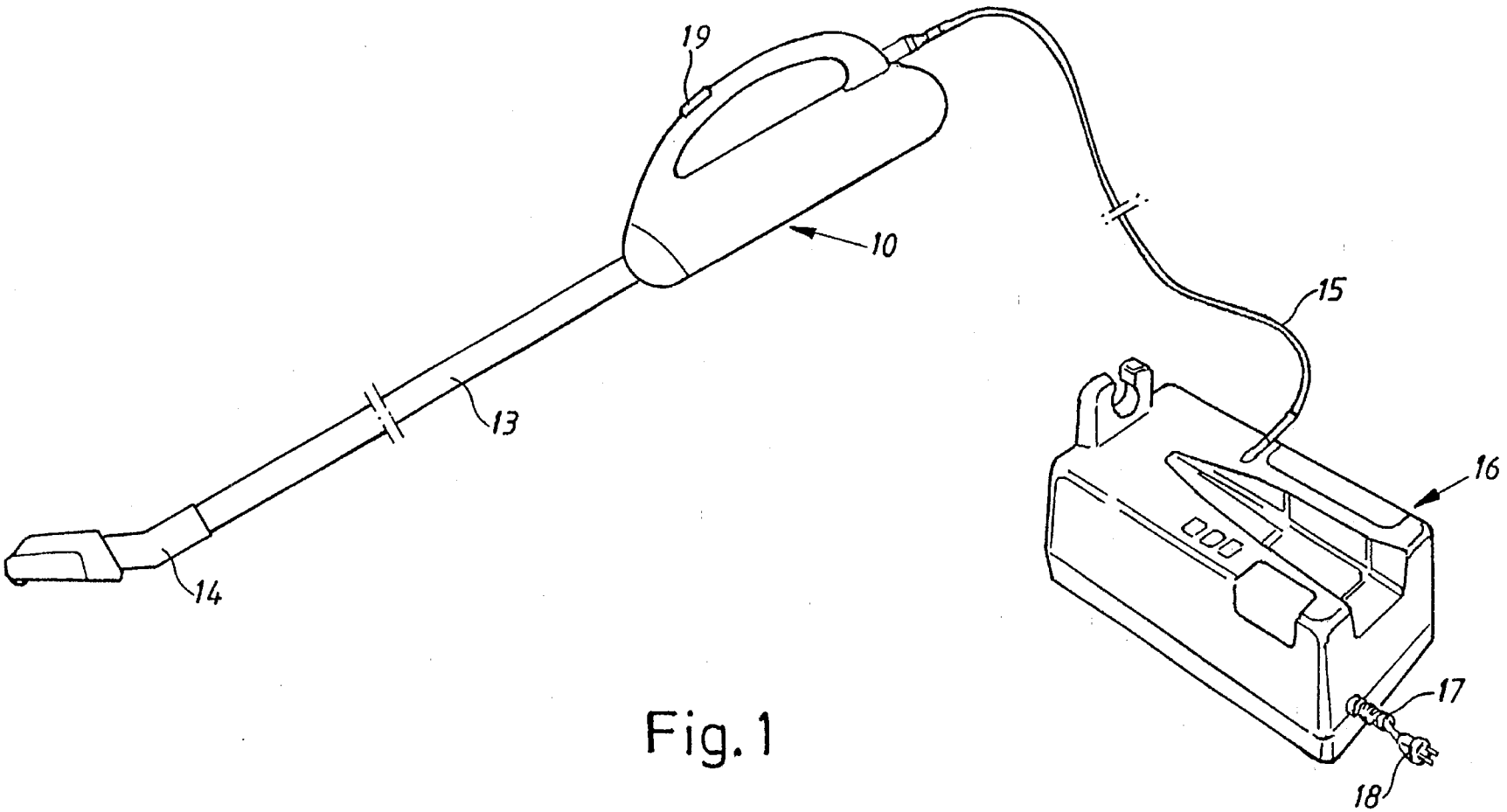
FIG. 1 is a schematic perspective view of a vacuum cleaner according to the present invention.
Figure 2:
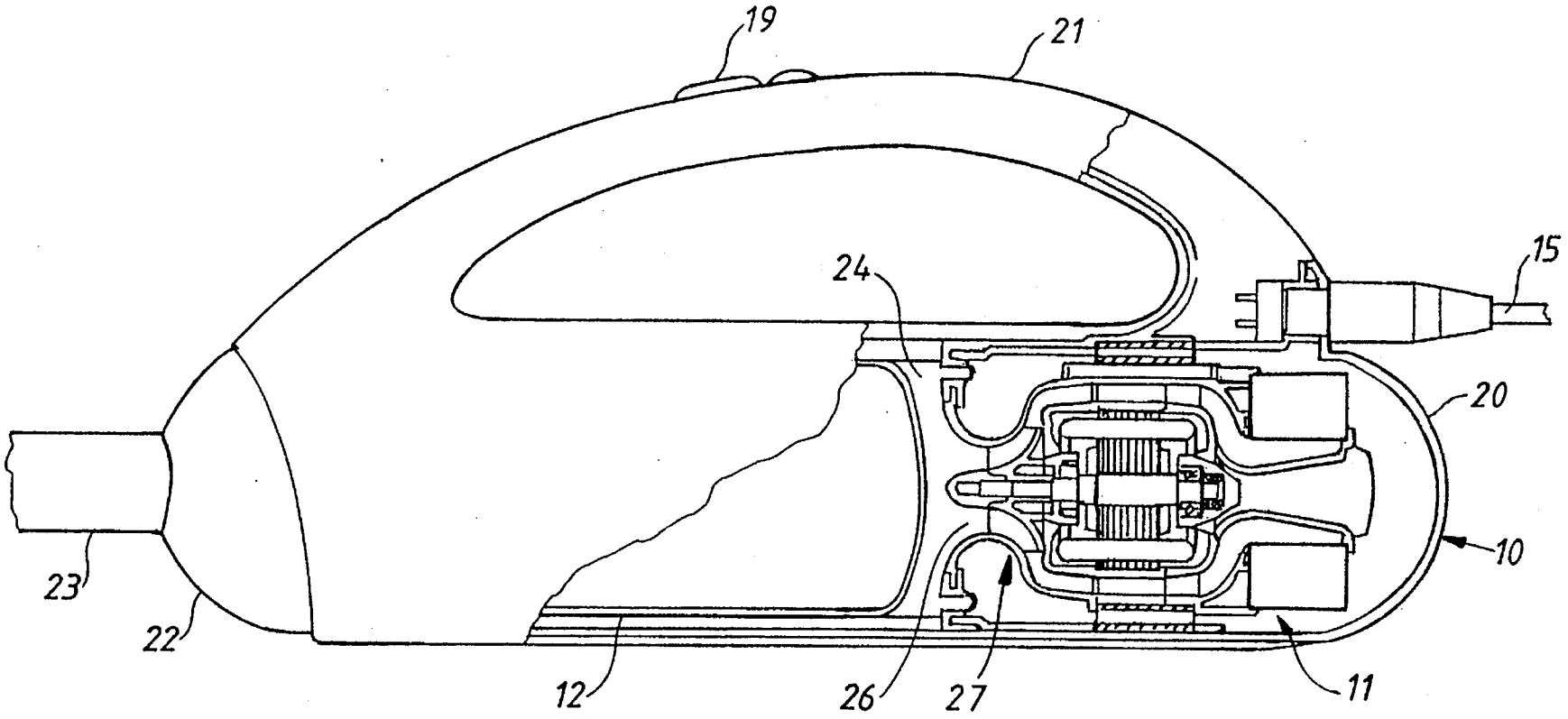
FIG. 2 is a longitudinal vertical section through the hand-held motor housing of the vacuum cleaner.

As shown in FIGS. 1 and 2, a vacuum cleaner according to the present invention comprises a hand-held motor housing 10 comprising a turbo-fan arrangement 11 and a dust bag 12. The motor housing 10 is connected to a nozzle 14 via a tube shaft 13. The motor housing 10 is, via a cable 15, connected to a base unit 16 which, by means of a cable 17 and a plug 18, can be connected to the electric supply system. The base unit 16 comprises, in addition to a cable reel and other accessories for the vacuum cleaner, electronic equipment which is necessary for operating the turbo-fan arrangement 11. Speed control is made by control means 19 placed on the motor housing 10.

Figure 3:
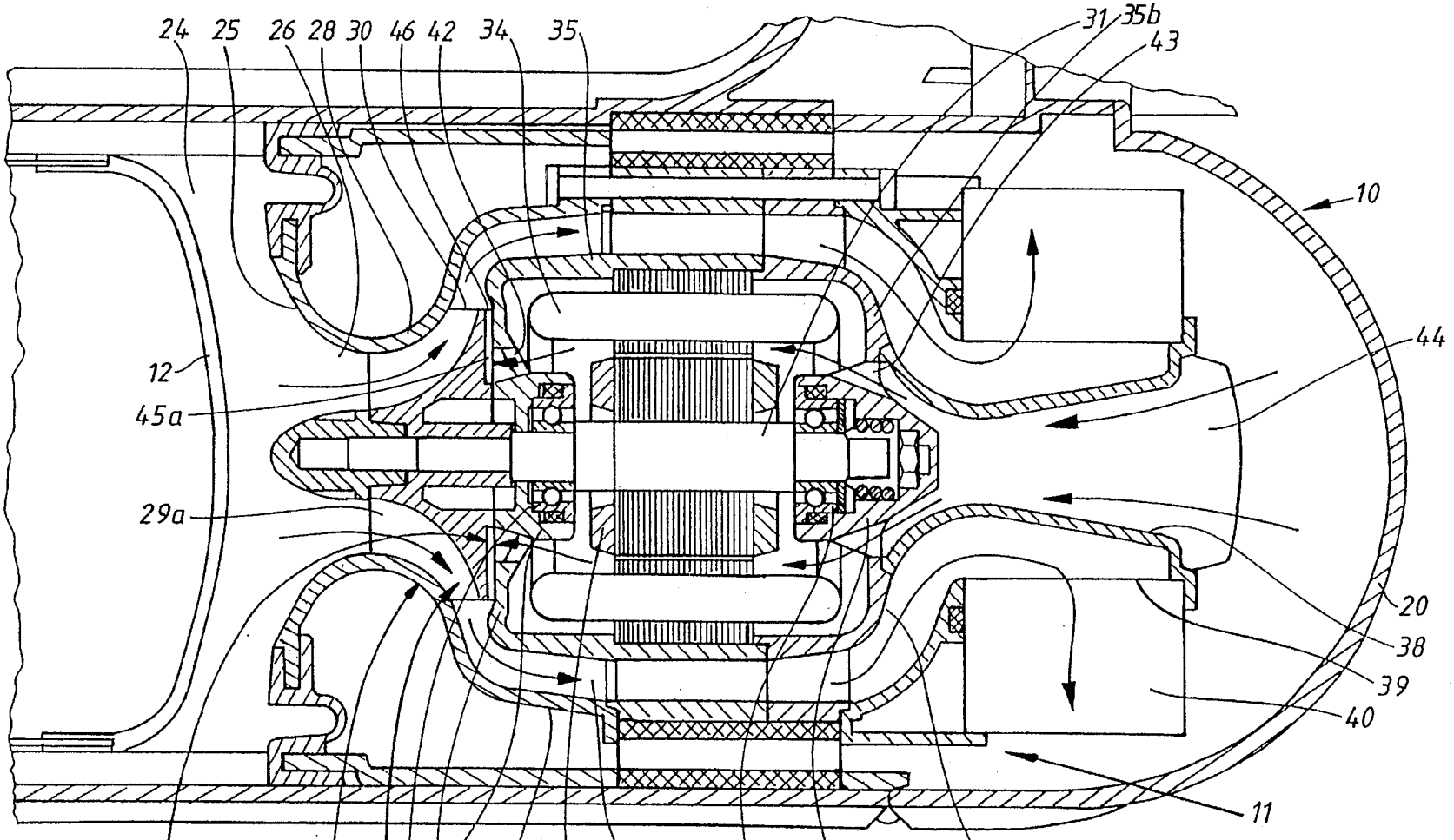
FIG. 3 is a longitudinal vertical section through the turbo-fan unit in the motor housing.

With reference to FIGS. 2 and 3, the motor housing 10 comprises a plastic hood 20 having a handle 21 in which the speed control means 19 are mounted. The front end of the plastic hood is shaped as a lid 22, and includes a tube socket 23 which can be fastened on the pipe shaft 13. The tube socket 23 opens into the dust bag 12 which is surrounded by a shell so that a tube-shaped channel 24 is created. The channel 24 continues in the direction toward the rear part of the motor housing 10 via a funnel-shaped inlet section 25 with a gradually decreasing section area, and into an inlet 26 for a turbo-fan unit 27 which is a part of the turbo-fan arrangement 11. The turbo-fan unit 27 comprises an electric motor 32 which is surrounded by a motor shell 35, a turbo-fan impeller 29, and an outer shell part 36. The outer shell part 36 forms or defines an inlet section 28 with gradually increasing sectional area. The turbo-fan impeller 29 has blades **29*a* a in close proximity to the inlet section 28. The turbo-fan unit 27 also has an outlet 30**.

The motor shell 35 includes a first end wall **35*a* and a second end wall 35*b*, each of which have a hub part 41*a*, 41*b* in which a motor shaft 31 is rotatably mounted by means of bearings 56. The shaft 31, which also supports the rotor of the motor 32, extends a short distance outside the first end wall 35*a* and has the turbo-fan impeller 29 fixed thereon. As noted hereinbefore and illustrated in FIG. 3, there is a small space between the impeller blades 29***a* and the inlet section 28 of the outer shell part 36. The turbo-fan impeller 29 is preferably shaped as an axial fan at the inlet 26 whereas, at the outlet 30, the impeller 29 is shaped as a radial fan. The electric motor 32 and, hence, the turbo-fan impeller 29, is driven at a speed above 50,000 rpm and, preferably, between about 70,000 and 120,000 rpm.

The stator 34 of the electric motor 32 is surrounded by the motor shell 35 which, together with a cylindrical portion of the outer shell part 36, forms an annular passage 37 into which the outlet 30 of the turbo-fan unit 27 opens. The rear end of the motor shell 35 is shaped as a cut-off tapered sleeve 38, one end of which, together with the outer shell part 36, forms a radial outlet 39 with a filter 40 through which the air flow or stream created by the turbo-fan unit 27 can leave to atmosphere.

The second end wall 35*b* of the motor shell 35 has several inlet openings 43 formed therein which are located outside and near the hub part 41*b*. The first end wall 35*a* of the motor shell 35 has several outlet openings 42 formed therein which are located outside and near the hub part 41*a*. Cooling air is drawn through an inlet 44 at the outer part of the sleeve 38, through the inlet openings 43 in the second end wall 35*b* into the interior of the motor shell 35 wherein it flows over the bearings 56, rotor 33, and stator 34, and through the outlet openings 42 in the first end wall 35*a* by means of a cooling fan 45.

The cooling fan 45 is preferably a centrifugal or radial fan which is arranged at the rear side of the turbo-fan impeller 29 so that blades 45*a* of the cooling fan 45 face toward the first end wall 35*a* of the motor shell 35. The cooling fan blades 45*a* have a small extension in the axial direction and are very close to the first end wall 35*a*. The first end wall 35*a* forms a part of a fan housing in which the outlet openings 42 are inlets for the cooling fan 45, while an outlet 46 of the cooling fan 45 is formed at the outer peripheral part of the cooling fan 45 and in close proximity to the outlet 30 of the turbo-fan unit. The cooling fan 45 can, of course, be a part which is removable from the turbo-fan impeller 29 or be integrated with it.

The device described above and shown in FIGS. 1–3 operates in the following way. By activating the control means 19, the electric motor 32 is started, which means that the shaft 31 together with the turbo-fan impeller 29 and the cooling fan 45 begins to rotate. When the motor 32 is running the shaft 31, turbo-fan impeller 29, and cooling fan 45 rotate at a speed above 50,000 rpm.

The turbo-fan impeller 29 creates a stream of air which is sucked through the nozzle 14 and which, via the tube shaft 13, enters into the dust bag 12 in which the dust particles are separated from the air stream. The cleaned or filtered air then continues through the channel 24 and the funnel-shaped inlet section 25, through the inlet 26 to the turbo-fan unit 27 from which it escapes as a primary air stream through the outlet 30 to the annular passage 37 surrounding the motor shell 35 and cools the outside of the motor 32 as it flows through the annular passage 37 before escaping through the outlet 39.

At the same time, cooling air, which is introduced into the motor housing 10 via openings (not shown) in the hood 20, is sucked into the motor shell 35 through the inlet 44 in the sleeve 38 by means of the cooling fan 45 in a counter-flow with respect to the air flowing through the annular passage 37. The cooling air, which is a secondary air stream, enters the motor shell 35 via the openings 43 in the second end wall 35*b* near the rearward hub part 41*b* and flows over the internal parts of the motor 32, thereby effectively cooling the bearings 56, stator 34, and rotor 33 before passing through the openings 42 in the first end wall 35*a* near the forward hub part 41*a* toward the cooling fan 45. The cooling air or secondary air stream then flows radially outwardly from the cooling fan 45 through the outlet 46 into the primary air stream which is leaving the turbo-fan unit 27 via outlet 30. The two air streams are mixed with each other and then flow through the passage 37, the outlet 39, and the filter 40 to atmosphere.

It has also proved to be possible to eliminate the blades of the cooling fan 45 and instead let the rear side of the turbo-fan impeller 29 be a mainly flat surface since the friction which is present between the rotating surface and the molecules of the air gases at these high speeds is sufficient to throw the molecules towards the periphery so that a cooling air flow or stream is created through the motor 32.

Figure 4:
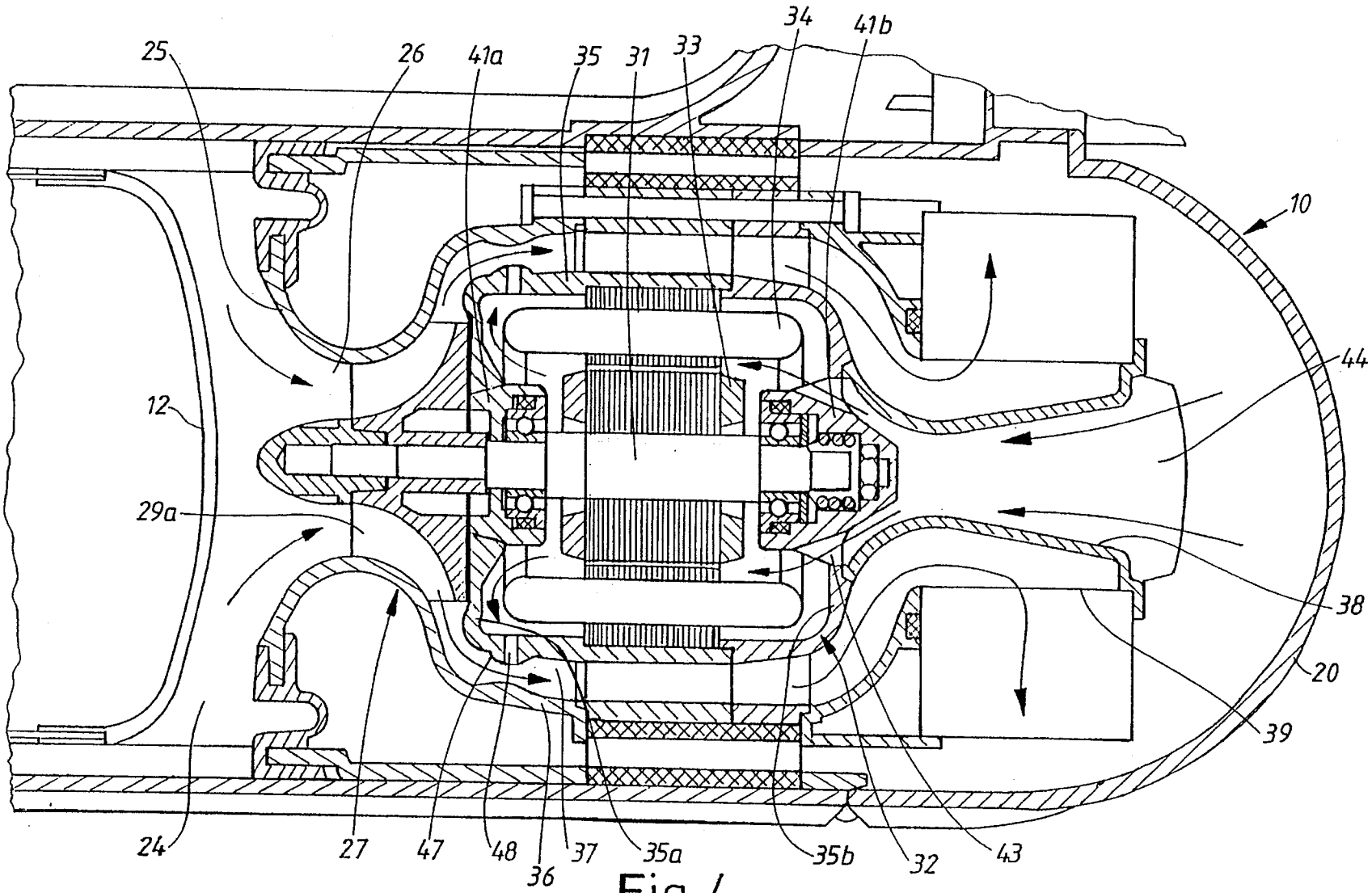
FIG. 4 is a longitudinal vertical section through the turbo-fan unit in the motor housing of an alternative embodiment of the turbo-fan unit.

The embodiment shown in FIG. 4 differs from that shown in FIG. 3 with respect to the cooling fan, which is missing in FIG. 4. Instead, the passage 37 has a narrow section 47 which, together with through openings 48 in the first end wall 35*a* of the motor shell 35, forms a venturi which sucks cooling air from the inlet 44 through the inlet openings 43 in the second end wall 35*b*, and into and through the motor 32. Although this embodiment provides a sufficient cooling air flow or stream during normal operating conditions, it has the disadvantage that there is no cooling if the primary air stream through the annular passage 37 is blocked, which could happen if something clogs the nozzle 14 or the tube shaft 13.

Figure 5:
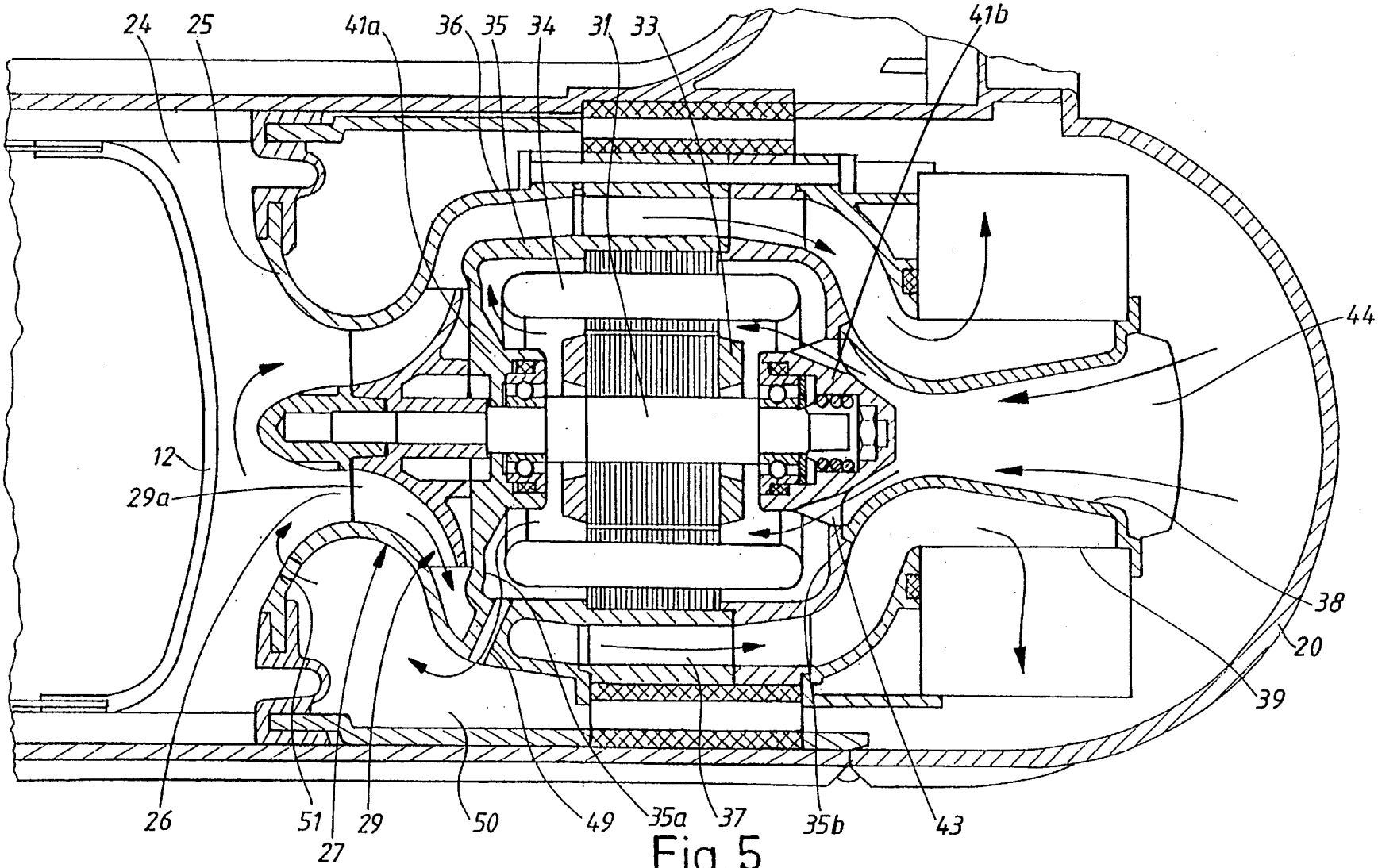
FIGS. 5–7 each show a longitudinal vertical section through the turbo-fan unit in the motor housing of three additional embodiments of the present invention.

The embodiment shown in FIG. 5 also has no separate cooling fan. Instead, the turbo-fan impeller 29 is operable to draw or suck cooling air from the inlet 44 through the electric motor 32 and through one or several channels 49 extending from the inside of the motor shell 35 to a chamber 50 outside the shell part 36. The chamber 50 communicates cooling air to the inlet 26 of the turbo-fan unit 27 via one or several openings 51 formed in the section 25. It should be noted that, in this embodiment, cooling air flow will be provided to the motor 32 even if the nozzle 14 or tube shaft 13 is clogged or blocked.

Figure 6:
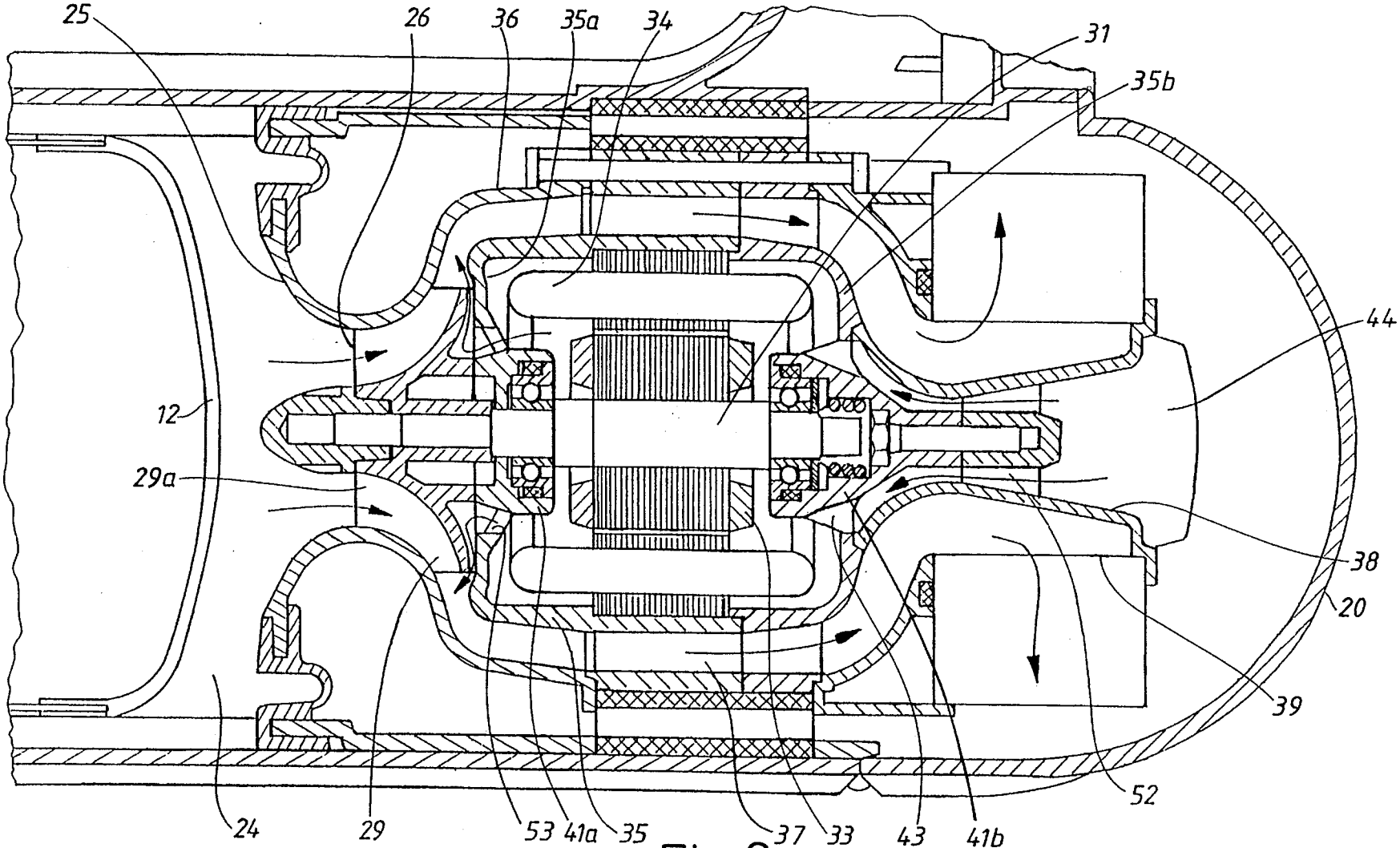

In the embodiment shown in FIG. 6, a cooling fan 52 is used which is placed at the inlet 44 for the cooling air, i.e., at the opposite side of the electric motor 32 with respect to the turbo-fan impeller 29. Cooling air is, by means of the cooling fan 52, forced through the electric motor 32 and into the primary air stream through openings 53 in the motor shell 35. The rear side of the turbo-fan impeller 29 may supplement cooling air flow through the motor 32.

Figure 7:
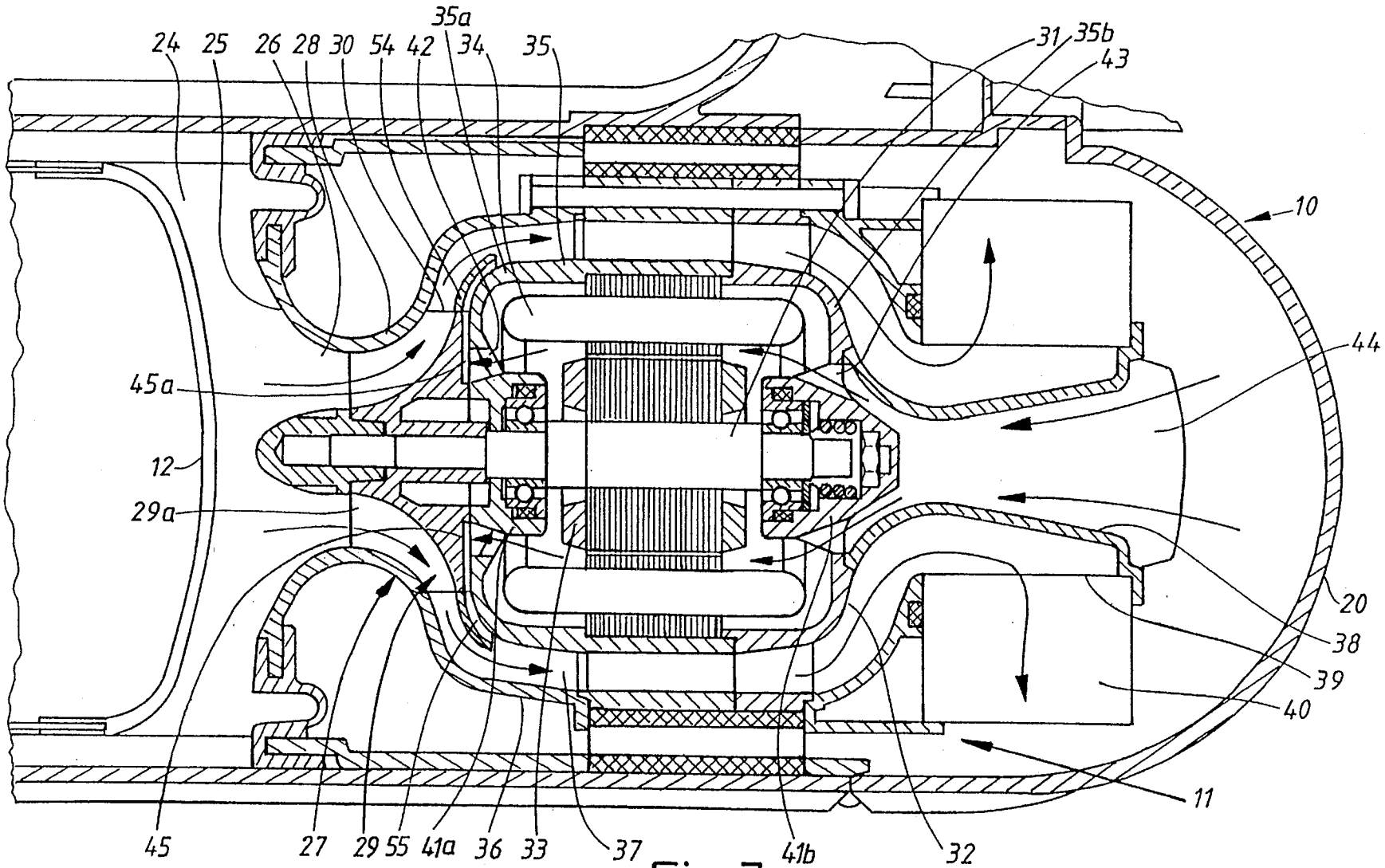

FIG. 7 shows an embodiment which is similar to the embodiment shown in FIG. 3, but in which there is a separate annular deflector plate 54 fixed to the outer shell 36 and surrounding the rear part of the impeller 29. The plate 54 is spaced a distance from the first end wall 35*a* of the motor shell 35 so that a passage 55 is formed between the plate 54 and the motor shell 35 through which the cooling or secondary air stream from the cooling fan 45 flows toward the primary air stream in the passage 37 mainly in the same direction as the primary stream.

The secondary air stream flows in the passage 55 between the deflector plate 54 and the motor shell 35 while the primary air stream flows outside the deflector plate 54. Thus, the primary air stream coming from the turbo-fan impeller 29 is initially separated from the secondary air stream coming from the cooling fan 45, thereby giving the two streams generally the same flow direction before they merge.

This arrangement has proved to give a considerable increase in the suction power or force.

By means of the suggested arrangements which are illustrated in FIGS. 2–3 and 5–7, an effective cooling of the motor 32 is always achieved at the high motor speed which is used, this cooling effect mainly being independent of the air flow through the nozzle 14.

Although the preferred embodiments of the present invention have been described in the foregoing detailed description and illustrated in the accompanying drawings, it should be understood that the present invention is not limited to the embodiments disclosed, but rather is capable of numerous rearrangements, modifications, and substitution of parts and elements without departing from the scope and spirit of the invention as defined by the claims appended hereto. For example, it is contemplated that the rearwardly mounted cooling fan 52 shown in FIG. 6 could be added to any of the embodiments of the present invention shown in FIGS. 3–5 and 7 to provide increased cooling air flow.

What is claimed is:

1. A vacuum cleaner having a suction nozzle (14), a dust bag (12), means connecting the suction nozzle to the dust bag, and a turbo-fan unit (27) including an impeller (29) driven by an electric motor and placed after the dust bag as seen in a direction of air flow, said impeller (29) being driven by the motor at a speed above 50,000 rpm and creating a primary air stream which exits the turbo-fan unit via an outlet (30), wherein the vacuum cleaner comprises means for creating a secondary air stream which at least partially cools the electric motor (32), said secondary air stream flowing into the electric motor via an inlet (43) which is separate from the primary air stream, at least a portion of the secondary air stream being directed into the primary air stream to form a combined air stream, said combined air stream flowing generally opposite the direction of said secondary air stream.

2. A vacuum cleaner according to claim 1, wherein the secondary air stream creating means comprises a cooling fan (45) which is located at the same side of the electric motor (32) as the turbo-fan unit (27).

3. A vacuum cleaner according to claim 2, wherein the cooling fan (45) and the impeller (29) are an integrated unit.

4. A vacuum cleaner according to claim 2, wherein the cooling fan is provided by a generally flat rear side of the impeller (29).

5. A vacuum cleaner according to any of claims 1, 2, 3, or 6, further comprising a passage (37) which directs the primary air stream around a shell (35) of the electric motor (31) while the secondary air stream flows within the motor shell (35) in a generally opposite direction to that of the primary air stream.

6. A vacuum cleaner having a suction nozzle (14), a dust bag (12), means connecting the suction nozzle to the dust bag, and a turbo-fan unit (27) including an impeller (29) driven by an electric motor and placed after the dust bag as seen in a direction of air flow, said impeller (29) being driven by the motor at a speed above 50,000 rpm and creating a primary air stream which exists the turbo-fan unit via an outlet (30), wherein the vacuum cleaner comprises means for creating a secondary air stream which at least partially cools the electric motor (32), said secondary air stream flowing into the electric motor via a cooling air inlet (43) is separate from the primary air stream, and wherein the electric motor includes a pair of hub parts (41) which support bearings for a shaft (31) of the electric motor, said cooling air inlet (43) to the electric motor is adjacent one of said hub parts while a cooling air outlet (42) from the electric motor is adjacent the other of said hub parts.

7. A vacuum cleaner according to claim 1, wherein said secondary air stream creating means is a venturi in which the primary air stream is the active medium of the venturi and in which the inlet (44) of the secondary air stream communicates with the suction side (48) of the venturi.

8. A vacuum cleaner according to claim 1, wherein said secondary air stream creating means is the turbo-fan unit (27), and a space within a shell of the electric motor communicates with the inlet (26) of the turbo-fan unit.

9. A vacuum cleaner according to claim 1, wherein said secondary air stream creating means includes a fan (52) for cooling air which is placed at a side of the electric motor opposite to that of the impeller (29).

10. A vacuum cleaner according to claim 6, further comprising a passage (37) which directs the primary air stream around a shell (35) of the electric motor (31) while the secondary air stream flows within the motor shell (35) in a generally opposite direction to that of the primary air stream.

11. A vacuum cleaner according to claim 6, wherein said secondary air stream creating means is a venturi in which the primary air stream is the active medium of the venturi and in which the inlet (44) of the secondary air stream communicates with the suction side (48) of the venturi.

12. A vacuum cleaner according to claim 6, wherein said secondary air stream creating means is the turbo-fan unit (27), and a space within a shell of the electric motor communicates with the inlet (26) of the turbo-fan unit.

13. A vacuum cleaner according to claim 6, wherein said secondary air stream creating means includes a fan (52) for cooling air which is placed at a side of the electric motor opposite to that of the impeller (29).

14. A vacuum cleaner according to claim 6, wherein the secondary air stream creating means comprises a cooling fan (45) which is located at the same side of the electric motor (32) as the turbo-fan unit (27).

15. A vacuum cleaner according to claim 14, wherein the cooling fan (45) and the impeller (29) are an integrated unit.

* * * * *